United States Patent [19]

Schulz et al.

[11] Patent Number: 4,686,096

[45] Date of Patent: Aug. 11, 1987

[54] CHOPPED CARBON FIBERS AND METHODS FOR PRODUCING THE SAME

[75] Inventors: David A. Schulz, Fairview Park; Loren C. Nelson, Strongsville, both of Ohio

[73] Assignee: Amoco Corporation, Chicago, Ill.

[21] Appl. No.: 632,839

[22] Filed: Jul. 20, 1984

[51] Int. Cl.[4] ..... D01F 9/12

[52] U.S. Cl. ..... 423/447.1; 423/447.2; 423/447.4; 423/447.6; 423/447.9; 264/29.2

[58] Field of Search ..... 423/447.1, 447.2, 447.9, 423/447.4, 447.6; 264/29.2

[56] References Cited

U.S. PATENT DOCUMENTS

| | | | |
|---|---|---|---|
| 532,468 | 1/1895 | Little | 423/447.9 |
| 3,595,946 | 7/1971 | Joo et al. | 264/29 |
| 3,664,900 | 5/1972 | Cuckson et al. | 423/447.1 |
| 3,936,535 | 2/1976 | Boder | 423/447.2 |
| 3,975,482 | 8/1976 | Rulison | 423/447.1 |
| 3,976,729 | 8/1976 | Lewis et al. | 264/29 |
| 4,005,183 | 1/1977 | Singer | 423/447.2 |
| 4,026,788 | 5/1977 | McHenry | 208/39 |
| 4,032,607 | 6/1977 | Schulz | 264/29.3 |
| 4,275,051 | 6/1981 | Barr | 264/29.2 |
| 4,276,278 | 6/1981 | Barr et al. | 423/447.4 |
| 4,303,631 | 12/1981 | Lewis et al. | 423/447.1 |

FOREIGN PATENT DOCUMENTS

| | | |
|---|---|---|
| 44-2510 | 2/1969 | Japan . |
| 71-7853 | 12/1971 | South Africa . |

OTHER PUBLICATIONS

International Committee for Characterization and Terminology of Carbon Publication, "First Publication of 30 Tentative Definitions in Carbon", vol. 20, pp. 445–449, 1982.

*Primary Examiner*—John Doll
*Assistant Examiner*—Robert L. Stoll
*Attorney, Agent, or Firm*—Richard J. Schlott; William H. Magidson; Ralph C. Medhurst

[57] ABSTRACT

Chopped carbon yarn is produced by spinning continuous pitch yarn, treating the pitch yarn with an oxidizing composition, chopping the pitch yarn into short lengths, collecting the chopped pitch yarn into a bulk form, and subjecting the chopped pitch yarn to a heat treatment in a substantially non-reactive atmosphere to produce chopped carbon yarn.

5 Claims, No Drawings

CHOPPED CARBON FIBERS AND METHODS FOR PRODUCING THE SAME

FIELD OF THE INVENTION

The invention relates to a method for the manufacture of chopped carbon fibers which avoids critical steps previously considered essential manufacturing steps for the production of chopped carbon fibers suitable for use in injection molding. More particularly, the invention is directed to a process which eliminates the independent step of infusibilizing mesophase pitch yarn prior to a carbonizing step for producing carbon yarn and eliminates the step of sizing the yarn to retain the chopped fibers within a chopped yarn length. The invention also relates to novel chopped carbon fibers and composite materials which include the chopped carbon fibers.

BACKGROUND OF THE INVENTION

Mesophase based carbon fibers are well known in the art since the issuance of U.S. Pat. No. 4,005,183. Numerous patents have issued relating the manufacture of mesophase pitch suitable for producing carbon fibers. Such patents include U.S. Pat. No. 4,026,788, U.S. Pat. No. 3,976,729, and U.S. Pat. No. 4,303,631.

It has been found in the art that mesophase pitch suitable for spinning pitch fibers contains at least 40% by weight mesophase so that the mesophase is the continuous phase, and the mesophase pitch upon quiescent heating forms domains at least 200 microns in size.

The spinning of mesophase pitch into continuous pitch fibers for the manufacturing of carbon fibers is usually carried out with a spinning apparatus which spins hundreds of fibers simultaneously, usually from 1500 to 2000 pitch fibers simultaneously. The average diameter of the pitch fibers is about 13 microns. The pitch fibers, say 2000, are treated together in subsequent steps. A bundle of continuous fibers is commonly referred to as "yarn" in the art. The carbon fibers are usually produced, packaged for shipping, and used in composites as yarns. Such yarns are sometimes referred to as "carbon yarns".

As used herein, the term "yarn" is a plurality of continuous fibers spun and processed together and the terms "pitch yarn", "infusibilized yarn", "carbon yarn" and "graphite yarn" are used to refer to the yarn at various stages of the manufacturing process.

Generally, the method for producing carbon fibers from mesophase pitch includes the steps of spinning the mesophase pitch into a plurality of pitch fibers (pitch yarn), infusibilizing the pitch fibers (infusibilized pitch yarn), and thereafter subjecting the infusibilized pitch fibers to a carbonizing step in a substantially non-reactive atmosphere for producing the carbon fibers (carbon yarn).

It is known from the prior art that the step of infusibilizing the pitch fibers is essential for the manufacture of carbon fibers because it enables the carbonizing step to be carried out relatively rapidly. The carbonizing step usually requires the yarn to be raised to a temperature of at least about 1000° C. It is desirable to be able to raise the temperature of the yarn from about room temperature to the final temperature, for example 1000° C., in a short time without causing deformation of the fibers, fusion between fibers, or a deterioration of the mechanical properties of the carbon yarn.

In the prior art, the infusibilizing step is particularly important for producing mesophase pitch based carbon fibers. Mesophase pitch derived carbon fibers are characterized by superior mechanical properties such as tensile strength and Young's modulus because the aromatic molecules of the mesophas pitch tend to orient parallel to the pitch fiber during the spinning of the mesophase pitch fibers. Raising the temperature of mesophase pitch fibers which have not been infusibilized to the softening point of the pitch fibers can result in the disorientation of the aromatic molecules and thereby substantially destroy the possibility of obtaining carbon fibers with superior mechanical properties.

The prior art has stressed the necessity of infusibilizing mesophase pitch yarn prior to the carbonizing step in order to avoid an extraordinary long period of time to raise the temperature of the yarn up from room temperature to the carbonizing temperature without deteriorating the qualities of the carbon yarn to be produced.

It is also essential, according to the prior art, to infusibilize non-mesophase pitch fibers to avoid having the fibers soften and thereby result in fusion between fibers in a yarn.

The step of infusibilizing pitch yarn is also referred to in the art as a "thermosetting step". The infusibilizing step is an exothermic reaction and the heat generated by the reaction can soften or deform fibers. The heat can cause fibers in a yarn to adhere or stick to each other and this reduces the tensile strength of the resulting carbon yarn as well as the properties of a composite made with the carbon yarn. This problem has been considered in U.S. Pat. No. 4,275,051 and U.S. Pat. No. 4,276,278.

The manufacturing of carbon fibers as reflected in the patent literature has been reviewed in the book entitled, "Carbon and Graphite Fibers, Manufacture and Application," published by Noyes Data Corporation, Park Ridge, N.J., 1980, edited by Marshall Sittig. This book sets forth the historical development of carbon fibers as derived from different precursor materials and the techniques patented for their manufacture. In addition, the book describes succinctly the various fiber treatment processes, matrices which are employed with carbon yarn in order to make composites, other reinforced materials which can be included in combination with carbon fibers to make effective composites, and the utilization of the carbon fibers in the manufacture of textile structures.

The International Committee for Characterization and Terminology of Carbon has published "First Publication of 30 Tentative Definitions" in *Carbon,* Vol. 20, pp. 445–449, 1982, to clarify the definition of many terms used in the art. The International Committee has defined "carbon fiber" as "filaments consisting of Non-Graphite Carbon obtained by Carbonization either of organic synthetic or natural fibres (PAN or others) or of fibres drawn from organic precursors such as resins or pitches, and by subsequent heat treatment of the carbonized fibres (up to temperatures of about 3000 K.)". The International Committee has also defined "Non-Graphitic Carbon" as "all varieties of substances consisting mainly of the element Carbon with two-dimensional long range order of the carbon atoms in planar hexagonal networks, but without any measurable crystallographic order in the third direction (c-direction) apart from more or less parallel stacking". The term "graphitic fiber" has been used in the art to describe carbon fibers which have been heat treated to between 2500 and 3000 K. The International Committee has pointed out that such fibers in most cases remain non-graphitic carbon so that the common term "graphitic fiber" is incorrect. The International Committe has pointed out, however, that "the term graphitic carbon is justified if Three Dimensional Crystalline Long Range Order can be detected in the material by diffraction methods, independent of the volume fraction and the homogeneity of distribution of such crystalline domains".

According to the prior art, the influsibilizing step is carried out in an oxidizing environment preferably at an elevated temperature in order to increase the rate at which the fibers become infusibilized. U.S. Pat. No. 4,389,387 discloses the problems of infusibilizing pitch fibers rapidly and effectively. The patent discloses that it is preferable to combine tens of thousands of pitch fibers into a tow of 10 to 30 mm in diameter in advance of the treatment for infusibilizing. The pitch fibers are loaded onto a net-belt conveyor and passed through a gaseous mixture of air and a gaseous oxidant such as oxygen, ozone, sulfur dioxide, nitrogen dioxide, etc. with the gaseous oxidant being 0.1 to 10% by volume of the gas mixture. The temperature for the infusibilizing step in the patent is lower than the softening point of the pitch fibers by at least 5° C. to 50° C. The time for infusibilizing is disclosed in the patent as from 1 to 4 hours. The patent states that problems of infusibilizing pitch fibers are overcome by moving the gaseous mixture through the packed pitch fibers. Nevertheless, the patent cautions against too large a packing height of pitch fibers to avoid insufficient removal of the generated heat.

South African Patent Application No. 71/7853, filed Nov. 4, 1971, entitled "Improvements In Or Relating To The Manufacture Of Carbon Fibers", disclosed processes for infusibilizing a fiber after it has been spun and prior to a carbonizing step. The infusibilizing step in the patent is referred to as "stabilizing". That is, "stabilizing" and infusibilizing are the same and are used interchangably in the patent. The precursor materials disclosed in the patent include solutions or extracts of coal, as well as pitches, pitch-like material and tar particularly if they are derived from coal.

The South African patent disclosed "that spun or extruded fibre, filament or film consisting of the organic material may be stabilized by heat treatment by reacting it with either an aqueous solution of bromine or an aqueous solution of nitric acid containing at least 25%, and preferably at least 40% by weight $HNO_3$ for at least sufficient time to stabilize the spun or extruded fibre, filament or film to heat treatment". The patent further discloses that the stabilized fiber can be further stabilized for a heat treatment by oxidation employing an oxidizing gas, preferably containing molecular oxygen at an elevated temperature.

The South African patent discloses that nitric acid reacts with coal and similar materials decomposing the coal and that the reaction of the nitric acid with the coal is a surface effect, the nitric acid in certain circumstances reacting with the coal violently, or even explosively.

According to the South African patent:

"If the nitric acid is allowed to react for an excessive period of time with the spun or extruded fibre, filament or film of the organic material, the nitric acid may react with the spun or extruded fibre, filament or film of the organic material in such a manner as to cause it to decompose. In the case where the organic material is a solution or extract of coal as hereinbefore referred to, it is believed the nitric acid may react with the solution or extract of coal, cleaving the large molecules of the solution or extract of coal, thereby causing the solution or extract of coal to have smaller molecules. This might have the effect of diminishing the strength of a spun or extruded fibre, filament or film of the solution or extract of coal or of the carbon fibre, filament or film produced therefrom. Accordingly, the spun or extruded fibre, filament or film, whether of the solution or extract of coal or of other organic material, should not be allowed to react with the aqueous solution of either bromine or nitric acid for such a length of time as will seriously detrimentally affect the properties of the stabilized fibre, filment or film or the carbon fibre, filament or film produced therefrom."

The South African patent provides a single example for the use of aqueous nitric acid. Example 1 discloses that a single filament having a diameter of 30 microns was cut into lengths and immersed in a solution comprising 50% by weight nitric acid at ambient temperature, about 20° C. The number of cut lengths was not stated in the Patent. The fiber lengths was then washed with water to remove the nitric acid and suspended in a vertical oven which was heated in nitrogen to temperature about 260° C. at a heating rate of 300° C. per hour and thereafter, the nitrogen atmosphere was replaced by oxygen for five minutes. Subsequently, the fibers were heated in nitrogen at the rate of 80° C. per hour to a temperature of 1000° C. and this temperature was held for one hour.

The remaining two examples of the South African patent discloses the use of bromine in water instead of aqueous nitric acid. For each of these examples, the rate of temperature increase for the carbonizing step was 50° C. per hour to a final temperature of 1000° C.

The South African patent discloses that it is imperative that the nitric acid be washed from a fiber in order to avoid a deterioration of the fiber from the nitric acid. The commercial utilization of the disclosure of the South African patent would require a washing step subsequent to a nitric acid treatment and that subsequent to the nitric acid treatment, a heat treatment in oxygen similar to the aforementioned example 1 is necessary.

Significantly, each of the examples in the South African patents set forth a carbonizing treatment in which the temperature was increased to 1000° C. at a rate of 50° C. or 80° C. per hour for separate cut lengths of the fiber suspended in a furnace. In contrast, a typically commercial carbonizing step for producing carbon fibers is for a yarn having typically at least 1000 filaments heated to a temperature of about 1000° C. in a furnace through which yarn passes. The yarn is subjected to a change from room temperature to the carbonizing temperature and again to room temperature. The time the yarn is subjected to the carbonizing temperature is in the order of about one second or less.

Japanese Pat. No. 564,648, based upon Patent Publication No. 2510/69, published Feb. 3, 1969, discloses a process of producing carbon fibers from dry distilled petroleum sludge having a sulfuric acid content below 30%. Spun fibers are given a surface treatment by being exposed to chlorine gas stream at a temperature between room temperature and 60° C. or dipped in a hydrogen peroxide, or hydrochloric acid, or nitric acid solution. Subsequently, the fibers are heated to 200° C. or more in an oxidizing atmosphere to complete the infusibilizing step. The final step is a heat treatment for carbonizing the treated fibers to produce carbon fibers.

The Japanese patent discloses that the surface treatment is necessary because the direct heating in an oxidizing atmosphere of the spun petroleum sludge fibers results in the fibers becoming soft and deformed.

U.S. Pat. No. 3,595,946 discloses oxidizing treatments for filaments of pitch either continuously as the filaments are emerging from the spinning machine or for batches of filaments wound into packages. The hot filaments from the spinning machine are passed through an oxidizing atmosphere such as air, ozone, nitric oxide, etc. The patent discloses that the filament from the spinning machine can be cooled to a temperature below its fusion point and then passed through a liquid oxidizing bath such as nitric acid, sulfuric acid, chromic acid, permanganate solutions and the like. The patent discloses that the oxidizing treatments can be applied to batches of filament wound into packages. The patent cautions that "the support of the filament package must be of such nature and/or construction that it yields or collapses as the wound filament contracts during the oxidation process." The patent further cautions:

> "The oxidation of filament wound to packages must follow a fairly critical heating regime if the superimposed and adjacent loops of filament are not to fuse together. This regime will naturally vary with the pitch, its previous oxidation history and the type and quality of additive present, if any. The best heating rates and soaking temperatures for a given material are naturally difficult to determine since the fusion temperature of the pitch changes as the oxidation proceed. Nevertheless, it has been established that a heat treated pitch of the type preferred, as described earlier, will yield filaments that are successfully oxidized by raising the temperature to 100° C. in less than 15 minutes, a non-critical step; holding the filament at 100° for about 20 hours; raising the temperatures from 100° to 195° C., at a preferred rate of about 5° C./hour; holding the filament at the later temperature for a period within the range of about 60 to about 120 hours, the upper part of that range being preferred. It should be noted that with certain materials temperature increase rates of up to 10° C./hour may be tolerated. In any event, the temperature at any time during the oxidation treatment should preferably be not higher than 10° C. below the softening point of the pitch at the given time. This batch type oxidation is best carried out in a circulating oven through which passes a constant flow of air oxygen containing gas, both fresh and recycled, pre-heated at the desired temperature."

Such a heating schedule is extremely long in time even after tests have been carried out to optimize the process to avoid fusion between filaments.

In view of the prior art, it appears that it is essential to carry out a separate infusibilizing step prior to a carbonizing step and that considerable care must be taken for infusibilizing pitch yarn to avoid sticking or fusing of fibers. Many attempts have been made in the art to simplify and expedite the infusibilizing step. The art, however, does not disclose any process for infusibilizing yarn other than as a separate step.

Moreover, the prior art requires an oxidizing atmosphere to infusibilize pitch fibers even after the pitch fiber has been treated with an oxidizing liquid, such as nitric acid.

After carbon yarn has been produced according to the prior art, the carbon yarn must be cut into short lengths to be suitable for use in injection molding. The yarn lengths are about 6 mm and are often referred to as "chopped fibers" in the art.

Generally, the use of chopped fibers as well as chopped glass fibers and other materials with a matrix material for injection molding is well known. The chopped fibers can improve mechanical properties, electrical properties, and thermal properties of a mold object.

U.S. Pat. No. 4,032,607 discloses self-bonded webs of non-woven carbon fibers produced by spinning mesophase pitch fibers, disposing staple lengths of the pitch fibers in a intimately contacting relationship with each other in a non-woven fibrous web, heating the web in an oxidizing atmosphere for a time sufficient to thermoset the surfaces of the fibers of the web to an extent which will allow the fibers to maintain their shape upon heating to elevated temperatures but insufficient to thermoset the interior portions of the fibers, heating the fibers under compressive pressure in non-reactive atmosphere to cause the interior portions of the fibers to exude out and contact the surfaces of adjacent fibers, and further heating to elevated temperatures wherein fibers are bonded together by infusible carbon bonds.

For injection molding, a straightforward mixing of the chopped fibers with pellets of the matrix material while the mixture is fed into an injection molding apparatus has a serious drawback. The chopped fibers within a given length can become disassociated and form clumps of fibers which interfere with and disrupt the uniform feed into the apparatus. Such problems are avoided in the prior art by the use of a "master batch". A "master batch" is a bath of pellets containing a mixture of the matrix material and chopped fibers, usually about equal volumes.

The master batch is produced by mixing matrix material and chopped fibers and feeding the mixture into an extruder. The extruded material is cut into pellets. The chopped fibers can form clumps during the process of feeding the mixture into the extruder and this can interfere and disrupt the extrusion. This problem is minimized by the use of a size such as a phenolic binder on the thermoset yarn which is dried and chopped up. The chopped thermoset yarn is then collected in a sagger and carbonized. The size tends to retain fibers together with a chopped length and thereby inhibit the formation of clumps.

The web according to U.S. Pat. No. 4,032,607 is not suitable for injection molding because there is substantially no relatively free flowing properties needed for feeding an extruder or an injection molding apparatus. In any event, the patent disclosed infusibilizing at least partially by heating in an oxidizing atmosphere as a separate step.

SUMMARY OF THE INVENTION

The present invention involves a process for manufacturing chopped mesophase based carbon yarn suitable for injection molding. The process comprises spinning mesophase pitch into a plurality of continuous fibers; combining the plurality of fibers to form a pitch yarn; contacting the pitch yarn with an oxidizing liquid composition; thereafter chopping the pitch yarn into short lengths suitable for injection molding, collecting the chopped pitch yarn into a bulk form, and subjecting the chopped pitch yarn in bulk form to a heat treatment in a substantially non-reactive atmosphere to produce chopped carbon yarn.

The oxidizing liquid composition enables the infusibilizing of the pitch yarn in the process according to the invention and also serves as a "size" or "sizing" for the pitch yarn. The terms "size" and "sizing" are used interchangeably in the art. In this connection, "sizing" on the pitch yarn tends to maintain the pitch fibers in the pitch yarn together and thereby minimize any separation of pitch fibers from the body of the pitch yarn. It is desirable to maintain the pitch fibers in the pitch yarn close together for the handling of the pitch yarn in the manufacturing operations.

DISCUSSION OF THE INVENTION

The invention substantially simplifies the manufacturing of chopped mesophase based carbon yarn suitable for injection molding and also greatly reduces the cost of manufacturing. This can be better appreciated by comparing the invention with a conventional process of making chopped carbon yarn.

Conventional manufacturing of mesophase based carbon yarn utilizes many operations and costly capital equipment. The following is a general description of a conventional manufacturing operation. A spinning apparatus produces 2000 continuous mesophase pitch fibers which are individually drawn down by a drawdown ratio of about 50:1 so that the average fiber diameter is about 12 microns. A drawdown is necessary to obtain the small diameter because spinning holes of about 12 microns in diameter would be expensive to produce and would clog easily.

It is well known in the art that carbon fibers having small diameters have generally better mechanical properties than relatively large diameter carbon fibers. Small diameter pitch fibers are used to obtain the small diameter carbon fibers.

The 2000 pitch fibers are sized and gathered together to form a pitch yarn.

The infusibilizing step is carried out by laying the pitch yarn onto a conveyor belt in a uniform pattern and the conveyor belt moves the pitch yarn into an oven.

The pitch fiber is mechanically weak and must be manipulated with considerable care. Accordingly, the system for laying the pitch yarn onto the conveyor belt is complex and rate limited.

The spinning apparatus is physically located above the conveyor belt. The pitch yarn enters a movable apparatus which physically moves transverse to the conveyor belt in order to lay the pitch yarn uniformly. This movable apparatus is referred to in the art as a "travelling godet" and is rate limited even for a careful design and can damage the pitch yarn because of the tendency of the pitch yarn to adhere to rolls within the apparatus. Such adhesion is due to surface tension arising from the sizing used to maintain the pitch fibers together to form the pitch yarn.

The travelling godet is followed by an apparatus called a "transvector" which draws the pitch yarn off of the last roll in the travelling godet with suction and directs the pitch yarn downward towards the conveyor belt. The transvector is not rate limited, but the air pressure moving in the vicinity of the pitch yarn can damage the pitch fibers.

The transvector is followed by a "laydown tube" which deposits the pitch yarn in a predetermined pattern onto the conveyor belt. A poor pattern distribution or too high a pile of pitch yarn can produce very high local heating due to the exothermic reaction during the infusibilizing step. The laydown tube is another potential problem because the pitch yarn wet with size occasionally adheres to the side of the tube for a short time and this interferes with the laydown pattern on the conveyor belt.

The conveyor belt carries the pitch yarn into a large oven having an oxidizing atmosphere and which has a predetermined heat gradient for infusibilizing the pitch yarn with as little damage as is consistent with commercial operations. This heat treatment can take as long as several hours. The cost of the oven as well as the energy costs are very high.

Subsequently, the infusibilized pitch yarn is pulled from the belt and is accumulated onto bobbins for easy handling and storage. This operation uses what is called a "downstream drive" and can be troublesome because the infusibilized pitch yarn is not much stronger than the pitch yarn. The infusibilized pitch yarn must be collected at a rate consistent with the spinning rate.

The infusibilized pitch yarn is sized to promote interfilament adhesion within a yarn bundle during a carbonizing step and is chopped into short lengths. Thereafter, the chopped fibers are carbonized.

The instant invention eliminates the need for the travelling godet, the transvector, the conveyor belt, the large oven and a downstream drive.

The instant invention also eliminates the necessity for sizing the infusibilized yarn to promote interfilament adhesion and chopping the yarn into short lengths as separate off line manufacturing steps.

In a preferred embodiment of the invention, a spinning apparatus produces a plurality of pitch fibers, for example 2000, and these pitch fibers are sized with an oxidizing liquid composition, gathered together into a yarn, and drawn down while being wound partly around the first roller, then between the first roller and an adjacent second roller, and finally between the second roller and an adjacent third roller which has a cutting device for chopping the yarn into short lengths. The chopped yarn is collected in a container below the third roller. The combination of drawing down the pitch yarn while cutting and collecting the yarn greatly simplifies the operations and eliminates many expensive pieces of equipment. Therafter, the chopped pitch yarn is subjected to a heat treatment in a substantially non-reactive atmosphere to produce chopped carbon yarn. No heat treatment in an oxidizing atmosphere is needed for the pitch yarn according to the invention in contrast to the prior art which required a heat treatment in oxygen or air or the like before the heat treatment in a substantially non-reactive atmosphere.

Surprisingly, the chopped yarn produced according to the invention exhibits a relatively high degree of adhesion between fibers within a given chopped yarn length and a relatively low degree of adhesion between fibers of different chopped yarn lengths.

The degree of adhesion depends on the ozidizing liquid composition used, the contact time between the composition and the yarn, and the rate of increase in temperature in the heat treatment.

The chopped carbon fibers produced according to the invention preferably have a bulk density of from about 250 g per liter to about 600 g per liter. This chopped carbon fiber is also characterized by good flow properties because a container of the chopped carbon fibers can be poured into another container with substantially no observed clamping and with a smooth continuous flow. Flow occurs at an angle of repose greater than about 45°.

The carbon yarn produced according to the invention provides a more efficient use of the precursor pitch than carbon yarn produced according to the prior art. The infusibilizing step of the prior art introduces considerable amounts of oxygen into the pitch yarn, as much as 18% or more by weight. During the carbonizating heat treatment, it is believed that some of the oxygen driven off carries along carbon atoms. As a result, the carbon yarn produced according to the prior art processes is less than 80% by weight of the pitch yarn. In contrast, the carbon yarn produced according to the invention is about 90% by weight of the pitch yarn. Thus, the invention provides a higher yield of product than the prior art besides simplifying the operations needed to produce carbon yarn.

The oxidizing liquid composition can serve many functions in addition to its use in the heat treatment. The composition can provide lubrication of the pitch yarn to minimize friction between the pitch yarn and portions of the equipment contacting the pitch yarn during the manufacturing operations. The composition can also provide adhesion between fibers so that the fibers remain together as a yarn.

In a preferred embodiment, the oxidizing liquid composition comprises an aqueous nitric acid. A concentration of the aqueous nitric acid of 10% to 50% by volume is preferable, but a concentration of 15% to 35% by volume is more preferable. It is preferable to use deionized water in the aqueos nitric acid to avoid introducing any undesirable ions onto and into the pitch fibers. Aqueous nitric acid is relatively inexpensive and has been found to be excellent in obtaining carbon yarn.

The concentration of the nitric acid depends on how long the nitric acid will be on the pitch yarn before the heat treatment is carried out. A concentration of about 25% by volume is suitable for commercial operations for which the time between the application of the nitric acid to the pitch yarn and the heat treatment varies from 1 to 5 days.

With regard to the oxidizing liquid composition, reference is had to the aforementioned U.S. Pat. Nos. 4,275,051 and No. 4,276,278, both entitled "Spin Size and Thermosetting Aid For Pitch Fibers". The former patent states that the invention "provides a method of treating a multifilament bundle of pitch fibers, such as yarn or tow, to prepare such multifilament bundle for further processing which comprises applying to the fibers thereof an aqueous finishing composition comprising a dispersion of graphite or carbon black in water in which is dissolved a first compound comprising a water-soluble oxidizing agent and a separate second compound comprising a water-soluble surfactant". The other patent features a water-soluble surfactant which is also capable of functioning as an oxidizing agent. Both of these patents relate to overcoming the sticking between fibers and feature the use of a dispersion of graphite or carbon black to achieve this goal. In contrast, the invention utilizes interfilament adhesion within a yarn length so that the use of a dispersion of graphite or carbon black would not be desirable in the instant oxidizing liquid composition. Both of these patents use the term "oxidizing agent" as a source of oxygen for the fiber in order to infusibilize the fiber. As used herein, "oxidizing liquid composition" includes a source of oxygen for infusibilizing the fiber. The disclosure of these patents is incorporated herein.

It is believed that the oxidizing liquid composition can comprise an aqueous acid or a water-soluble oxidizing agent such as a peroxygenated compound. Some water-soluble oxidizing agents compounds include sodium peroxide, potassium peroxide, ammonium peroxide, sodium persulfate, potassium persulfate, ammonium persulfate, sodium pyrosulfate, and sodium nitrate. Preferably, aqueous nitric acid is used in the composition.

One of the functions of the surfactant in the aforementioned U.S. Pat. No. 4,275,051 and No. 4,276,278 is to maintain a dispersion of the carbon black particles. This is not the case in this invention. The surfactant improves the flow of the composition over the fibers. It is believed that the surfactant can be a water-soluble and can be anionic or nonionic. Such surfactants are well known and typically include tetra-methyl sodium oleate, tetramethyl ammonium oleate, tetramethyl sodium laurate, tetramethyl ammonium laurate, sodium laurate and ammonium laurate.

The oxidizing liquid composition can be applied to the pitch fibers using prior art techniques for applying sizing. Preferably, the composition is applied by contacting the pitch yarn with a rotating wheel which passes through the solution and carries a portion of the solution on its surface to the pitch yarn. Such a wheel is often referred to in the art as a "kiss wheel" and rotates to minimize friction with the yarn as well as carrying new solution to the yarn. After the kiss wheel, the yarn can be accumulated for subsequent treatment.

The composition can be applied to the pitch yarn by passing the yarn through a bath of the composition. This has a drawback because high speeds can produce fiber damage due to drag in the bath.

Another way of applying the composition to the pitch yarn is to spray a mist of the composition onto the pitch fibers before the fibers are gathered to form the yarn in order to improve the distribution of the composition as the fibers.

The chopped pitch yarn can be collected in a container made of stainless steel, or a refractory alloy, or ceramic, or boron nitride, or more preferable a graphite material.

The pitch yarn which has been contacted with the oxidizing liquid composition reacts and incorporates oxygen thereby. Tests were carried out to determine the range of oxygen pickup in pitch yarn over a period of 0.1 hour to 70 hours. The yarn had 2000 pitch fibers which had an average filament diameter of 13.5 microns. Nitric acid with a concentration of 25% by volume was used. After the yarn was contacted with the nitric acid, a predetermined time was allowed to elapse at room temperature and thereafter, the yarn was washed with water for this test and dried at 125° C. for 16 hours prior to the test for oxygen content. Surprisingly, the range of oxygen pickup was 1.5% to 4.8% by weight for 0.1 hour to 70 hours with most of the oxygen pickup taking place during the first 24 hours. The test points substantially define the following relationship:

$$\text{Oxygen Pickup (\% by wt.)} = 1.2355 \log (\text{time in hrs.}) + 2.5278$$

Thus, the variations in the pitch yarn after contact with the nitric acid in this concentration is not expected to have any significant effect on the commercial operations. That is, treated chopped pitch yarn can be stored prior to being carbonized. This is advantageous in commercial manufacturing.

The heat treatment of the treated pitch yarn can be carried out in batches in a closed volume furnace or as a continuous process using for example a conveyor belt furnace or a so-called "walking beam furnace" in which graphite containers can be moved into and out of the furnace continuously.

The furnace should be capable of providing sufficient heat to pyrolyze the chopped yarn and allow a substantially non-reactive atmosphere to be maintained so that the yarn is not consumed. The non-reactive atmosphere in the furnace can be nitrogen, argon, helium or the like. For temperatures greater than about 2500° C., argon and helium are preferable.

Preferably, the heat treatment is carried out in a completely non-reactive atmosphere established by purging the furnace thoroughly. It is believed that a small amount of oxygen would not be harmful, particularly if the temperature was not raised too rapidly. It can be appreciated that yarn wet from being treated with oxidizing liquid composition will produce an atmosphere of steam which should be purged before elevated temperatures are reached at which steam is no longer substantially non-reactive. The use of boron or similar graphitizing components could be used in the furnace atmosphere and are considered non-reactive as used herein.

In carrying out the invention, the furnace was purged of air prior to raising the temperature of the chopped yarn. The purging step can be carried out by subjecting the interior of the furnace to a vacuum and then allowing the interior to fill with nitrogen.

The heat treatment according to the invention has three broad ranges which are important in deciding a heating schedule for rate of temperature increase. The rate of temperature increase up to about 400° C. should take into account that the pitch fibers do not become completely infusibilized until they reach about 400° C. Too rapid increase in temperature up to 400° C. can result in fiber deformation due to softening, excessive fusion between fibers, and/or disorientation of mesophase molecules.

The temperature increase above 400° C. can be at a higher rate, but must take into account that most of the gas loss for the pyrolizing or carbonizing process occurs as the fibers are heated between about 400° C. and about 800° C. Too rapid an increase can result in damage due to evolving gases.

The increase in temperature above 800° C. can be as great as desired. Typically, the final temperature is from 1300° C. to 2700° C. depending on the intended use of the chopped carbon yarn.

Generally, the heat treatment according to the invention is carried out in a substantially non-reactive atmosphere and the temperature can be raised from room temperature at a rate of about 100° C. per hour until 800° C. Thereafter, the temperature can be increased as fast as desired to a predetermined final temperature.

The rate of increase in temperature up to 400° C. depends, in part, on the sizing used, contact time between the pitch yarn and the oxidizing liquid composition. the softening point of the pitch, the diameter of the fibers, and the composition of the pitch.

Preferably, the heat schedule for the furnace is 25° C. per hour from room temperature to about 400° C. then 50° C. per hour until about 800°. Thereafter, the temperature can be raised as fast as desired to a predetermined final temperature.

Preferably, the bulk density of the chopped carbon yarn is in the range of from about 250 to about 600 g per liter.

EXAMPLES

Several examples were carried out to demonstrate the invention and to measure properties of injection molded products incorporating chopped carbon yarn produced by the invention.

The pitch fibers for the examples were produced according to conventional melt spinning processes. The mesophase pitch is heated in an extruder above the melting point of the mesophase pitch to obtain a molten state. The extruder pushes the molten pitch through a filter to a metering pump in the spin block. The molten pitch passes through a filterpack before reaching the spinnerette cavities. Each spinnerette contains 2,000 holes of 0.3 mm diameter and 0.6 mm capillary length. As the pitch fibers emerge from the spinnerette plate they are drawn down to about 13 microns or less and are immediately quenched with nitrogen so that the pitch hardens. Below the quench chamber, aqueous nitric acid having a concentration of 25% by volume is applied to the filaments. The pitch yarn is then moved around a first roller, between first and second rollers, continued around the second roller, and passed between second and third rollers. The third roller has spaced apart cutters for cutting yarn lengths of about 6 millimeters.

EXAMPLES 1 TO 3

A mesophase pitch having a mesophase content of about 78% by weight and a Mettler softening point of about 325° C. was spun into 2000 filaments. The pitch fibers were drawndown for the Examples 1 to 3 to have average diameters of about 9 microns, 10 microns, and 13 microns, respectively. In each example, the filaments were drawn together to form a pitch yarn and aqueous nitric acid having a concentration of about 25% by volume was applied to the rapidly moving pitch yarn using two rotating kiss wheels. For each example the amount of acid picked up was about 0.5 g of 25% nitric acid per gram of pitch fiber. In each example, the third roller chopped the pitch yarn into 6 millimeter lengths.

The chopped pitch yarn was collected in a graphite container having an inside diameter of about 36 cm., a height of about 92 cm. and a wall thickness of about 2.5 cm. For each example the collected weight was about 23 kg.

The chopped pitch yarn in the graphite containers was stored for about three days before proceeding with the heat treatment. For each example the heat treatment was carried out in an induction furnace. The furnace was purged for four hours with nitrogen before the temperature was increased. The temperature of the furnace was increased from room temperature at a rate of about 50° per hour until a temperature of about 800° was reached. Thereafter, the temperature was increased to about 1300° to about one hour and this temperature was maintained for about two hours before the furnace power was turned off. The furnace was allowed to cool to room temperature in due course.

The chopped carbon yarn for each example was evaluated and found to have similar properties. The average carbon content was about 98% by weight. The fibers within a typical chopped carbon yarn length were lightly adhered to each other but the separate chopped carbon yarn lengths flowed freely when poured from one container to another. The average bulk density in each example was about 400 g per liter.

A test was carried out to determine the capability of the chopped carbon yarn to tolerate rough handling such as might occur in commercial shipping. An empty one gallon paint can was loaded to about 50% volume capacity with the chopped carbon yarn from Example 3 and then subjected to agitation in a commercial paint shaker for about 33 minutes. There were hardly any changes in the flow properties and the average bulk density after this harsh treatment remained greater than 225 grams per liter.

EXAMPLE 4

For comparison, chopped carbon yarn was prepared according to conventional methods.

A mesophase pitch similar to the mesophase pitch of Examples 1 to 3 was spun into pitch filaments, drawn down to an average diameter of about 11 microns, and then drawn together to form a pitch yarn as in the Examples 1 to 3.

The pitch yarn was infusibilized by heating the yarn to 350° in air for 2 hours and phenolic binder was applied to the infusibilized pitch yarn with a kiss wheel. The yarn was thereafter dried and cut into chopped lengths. These lengths were collected in a graphite container as in the Examples 1 to 3 and subjected to the same heat treatment to produce chopped carbon yarn.

EXAMPLE 5

The chopped carbon yarn of the Examples 1 to 4 were used in injection molding in the following manner.

A master batch of each chopped carbon yarn was prepared with nylon 6,6 being 70% by weight. Each master batch was prepared using a commercial extruder to produce pellets having average dimensions of 10 mm diameter and 15 mm long. The feed of the chopped carbon yarn in each case was good and tests show that the pellets in each case had a uniform dispersion of chopped fibers.

The pellets were used in an injection molding apparatus to produce composites. Table 1 shows the results of measurements of properties of the composites.

TABLE 1

| Property | ASTM | Ex. 1 | Ex. 2 | Ex. 3 | Ex. 4 |
|---|---|---|---|---|---|
| Tensile Strength, MPa | D-1708 | 150 | 138 | 132 | 91.0 |
| Tensile Modulus, GPa | D-1708 | 12.4 | 11.7 | 11.7 | 8.8 |
| Impact Strength K Joule/m$^2$ | D-256 | 63.1 | 35.7 | 35.7 | 23.1 |
| Flexural Strength MPa | D-790 | 226 | 200 | 198 | 155 |
| Electrical Resistivity ohm-cm | — | 1.6 | 2.3 | 2.8 | 5.0 |

We claim:

1. A process for manufacturing chopped carbon yarn, consisting essentially of:

(a) spinning pitch into a plurality of continuous fibers;

(b) combining the plurality of continuous fibers to form a pitch yarn;

(c) treating the pitch yarn with an aqueous composition comprising nitric acid and a water-soluble surfactant (d) chopping the treated pitch yarn into short lengths suitable for injection molding;

(e) collecting the chopped pitch yarn into a bulk form; and then (f) subjecting the chopped pitch yarn in bulk form to a heat treatment in a substantially non-reactive atmosphere to produce the chopped carbon yarn.

2. The process of claim 1, wherein the pitch is mesophase pitch.

3. The process of claim 1, wherein said aqueous nitric acid has a concentration of from about 10% to about 50% by volume.

4. The process of claim, 3 wherein the aqueous nitric acid has a concentration of from about 15% to about 35% by volume.

5. The process of claim 1, wherein the heat treatment is carried out by raising the temperature of the fiber from room temperature to about 400° C. at the rate of about 25° C. per hour and then raised to 800° C. at the rate of about 50° C. per hour, without exceeding the softening point of the fiber during the heat treatment.

* * * * *